United States Patent [19]

Russell

[11] 4,302,513

[45] Nov. 24, 1981

[54] ELASTIC TYPING MEDIUM FOR REDUCTION OF MESSAGE SIZE

[76] Inventor: David E. Russell, 110 Riverside Ave., Jacksonville, Fla. 32202

[21] Appl. No.: 176,081

[22] Filed: Aug. 7, 1980

[51] Int. Cl.[3] ..... B41D 7/04; B41B 13/04; B41M 5/00; B41M 1/32

[52] U.S. Cl. ..... 428/492; 273/240; 346/134; 346/135.1; 400/14; 428/40; 428/47; 428/77; 428/98; 428/192; 428/496; 428/542; 428/908; 428/910; 434/81; 434/227

[58] Field of Search ..... 428/40, 77, 98, 192, 428/425, 492, 496, 542, 908, 910, 47; 400/14; 346/134, 135.1; 434/81, 227; 273/240

[56] References Cited

U.S. PATENT DOCUMENTS

| | | | |
|---|---|---|---|
| 2,177,539 | 10/1939 | Spielvogel | 400/14 |
| 2,664,043 | 12/1953 | Dalton | 346/135.1 |
| 2,887,941 | 5/1959 | Horne | 400/14 |
| 3,790,435 | 2/1974 | Tanba | 428/910 |
| 4,097,645 | 6/1978 | Toyoda | 428/306 |

OTHER PUBLICATIONS

Advertisement for Craft Master Incredible Shrinking Art Kits, *Playthings,* Jul. 1975, p. 16.

*Primary Examiner*—Dennis L. Albrecht

[57] ABSTRACT

During manufacture, a rubber or other elastic sheet is forcibly stretched out and smoothly affixed to an adhesive spread out on a backing of cardboard or similar material. The sheet is suitable for receiving typing from a typewriter, and the entire assembly is suitable for insertion and bending over the roll of a common typewriter. During operation, a person types a message on the sheet, removes the assembly from the typewriter and forcibly peels the sheet off the backing. The sheet returns to its original unstretched shape, and the typed words, along with the spaces between the words, occupy less space than those of a similar message typed on ordinary paper. When used with a Xerox or similar copying machine, the reduction in the size of the words and spaces permits the use of many more words per final, normal size page of reproduced document.

1 Claim, 1 Drawing Figure

ELASTIC TYPING MEDIUM FOR REDUCTION OF MESSAGE SIZE

BACKGROUND OF THE INVENTION

1. Field of Invention

The present invention relates to media for typewritten messages and more particularly to the reduction in size of the media for use in copying on Xerox or similar copying machines.

2. Description of the Prior Art

The reduction in size of typewritten characters and spaces, so that more words can be used per page and the total number of pages for a given document can be reduced, is well known. Copy machines with optical methods of size reduction are known, and contract services for size reduction are available outside the office of the user of a copy machine. The present invention is not known to exist.

SUMMARY OF THE INVENTION

A need exists, on the part of the owner of a simple Xerox or similar copying machine, for a simple, inexpensive means of reducing the size of typewritten characters and spaces so that more words can appear on a given page, and the total number of pages of a long document can be reduced. Accordingly, the principal object of the present invention is to provide such a means with a stretched elastic sheet mounted on a cardboard backing in such a manner that the sheet can receive typing, be reduced in size mechanically and be copied in its reduced size.

Another object of the present invention is to provide a device which, because of its simplicity, can be readily understood and used by any typist.

Yet another object of the present invention is to provide a simple, low cost means of reducing the size of typewritten and other inscribed characters which avoids the use of more costly and elaborate size reduction methods.

Still another object of the present invention is to provide a design which, because of its simple construction, can be economically produced by conventional mass production methods and can be easily handled, packaged and distributed.

BRIEF DESCRIPTION OF THE DRAWINGS

The novel features which are believed to be characteristic of this invention are set forth with particularly in the appended claims. The invention itself, however, both as to its organization and method of operation, together with further objects and advantages thereof, may best be understood by reference to the following description taken in connection with the accompanying drawings, in which:

The FIGURE is a pictorial view of an assembly of the present invention to accord with one embodiment of the invention.

Figure 1:
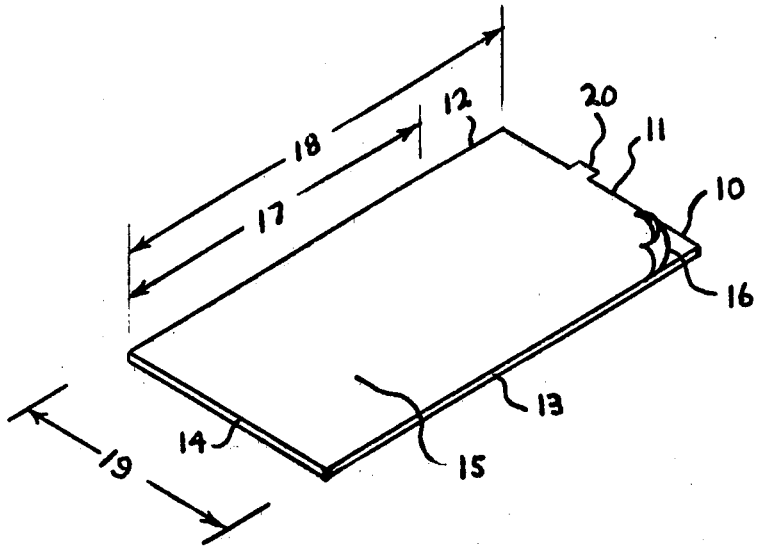

The drawings are illustrations only, and changes may be made in the specific constructions illustrated and described, so long as the scope of the appended claims is not voided.

DESCRIPTION OF THE PREFERRED EMBODIMENT

10 is a sheet of semirigid cardboard suitable for insertion in an ordinary typewriter and for bending around the roll of the typewriter. 11 is the top edge, 12 is the left edge, 13 is the right edge and 14 is the bottom edge of the cardboard. 15 is a thin sheet of rubber, latex or other suitable elastomer or elastic material uniformly stretched and affixed to the entire obverse surface of 10. 16 is a portion of 15 shown peeled back for clarity. Before stretching and mounting on 10, 15 had the length indicated by dimension 17 and the width indicated by dimension 19. After stretching and mounting on 10, 15 has the length indicated by dimension 18 and the width indicated by dimension 19. 18 and 19 are also the fixed dimensions of 10. 15 is adfixed to 10 with a suitable pressure type adhesive which had previously been applied to the entire obverse surface of 10.

The physical characteristics of 10, 15 and the adhesive are properly selected and matched so that 15 will not pull away from 10 of its own accord, yet 15 can be manually and forcibly peeled off of 10 and allowed to contract from its stretched dimension 18 to its original relaxed dimension 17. 10 should also be rigid enough to withstand bending due to the stretching forces of 15. The surface of 15 should be capable of receiving typewriter ink characters and ink pen messages.

To use, the operator inserts the entire assembly, as described hereinbefore, into an ordinary typewriter and types the desired message on the exposed surface of the elastic sheet. Upon completion of the typing, the entire assembly is removed from the typewriter, 15 is manually peeled off of 10, and 15 is allowed to contract to its original unstretched shape. The typewritten characters now have a compressed appearance with more message per page than would be normally possible. 15, detached from 10, can now be placed on a Xerox or similar copying machine (or can be placed in a transparent carrier for use in the machine).

20 is an optional tab extension of 15 to facilitate peeling 15 off of 10. (An indentation of 10 may also be employed to facilitate peeling in lieu of 20.) An optional, detachable clip (not shown) can be provided at edge 11 so as to lessen the stretch force of 15 and permit long-term storage of the assembly without a gradual pulling away of 15 from 10.

Although the illustrated preferred embodiment shows stretching of the elastic sheet in one direction only, the elastic sheet may also be stretched in a direction perpendicular to that shown and the width of the backing may be increased so as to increase the amount of information which may be typed on the sheet. Distortion can be minimized by adjusting the force pattern employed in stretching the sheet prior to mounting on the adhesive.

While the invention has been described with respect to certain specific embodiments, it will be appreciated that many modifications and changes may be made by those skilled in the art without departing from the spirit of the invention. It is intended, therefore, by the appended claim to cover all such modifications and changes as fall within the true spirit and scope of the invention.

What is claimed as new and what it is desired to secure by Letters Patent of the United States is:

1. In combination, a cardboard or similar semirigid sheet or plate, suitable for insertion in a typewriter roll, and a stretched sheet of rubber, elastomer or other elastic material capable of receiving typing or ink inscriptions mounted on said sheet or plate with a pressure type adhesive in such a manner that the sheet can be manually removed thereby allowing the sheet to return through inherent elastic force to a smaller size presenting typewritten or inked messages and figures of a reduced size.

* * * * *